US006913316B2

(12) United States Patent
Kinoshita et al.

(10) Patent No.: US 6,913,316 B2
(45) Date of Patent: Jul. 5, 2005

(54) CHAIR

(75) Inventors: Yojiro Kinoshita, Osaka (JP); Nobuyuki Ueda, Osaka (JP)

(73) Assignee: Kokuyo Co., Ltd. (JP)

( * ) Notice: Subject to any disclaimer, the term of this patent is extended or adjusted under 35 U.S.C. 154(b) by 56 days.

(21) Appl. No.: 10/130,746

(22) PCT Filed: Oct. 3, 2001

(86) PCT No.: PCT/JP01/08732

§ 371 (c)(1),
(2), (4) Date: May 23, 2002

(87) PCT Pub. No.: WO02/32264

PCT Pub. Date: Apr. 25, 2002

(65) Prior Publication Data

US 2003/0137173 A1 Jul. 24, 2003

(30) Foreign Application Priority Data

Oct. 16, 2000 (JP) ..... P2000-314997
Oct. 16, 2000 (JP) ..... P2000-315781

(51) Int. Cl.[7] ..... A47C 1/024; A47C 1/038; A47C 3/026

(52) U.S. Cl. ..... 297/300.3; 297/300.1; 297/300.4; 297/301.1; 297/301.2; 297/320

(58) Field of Search ..... 297/300.3, 300.1, 297/300.2, 300.4, 301.1, 301.2, 320

(56) References Cited

U.S. PATENT DOCUMENTS 2,365,200 A * 12/1944 Lorenz ..... 297/300.4 X
3,773,383 A * 11/1973 Ekornes ..... 297/320
3,989,297 A 11/1976 Kerstholt
4,200,332 A * 4/1980 Brauning ..... 297/300.3
4,270,797 A * 6/1981 Brauning ..... 297/300.3
4,364,605 A * 12/1982 Meiller ..... 297/300.3
4,603,905 A * 8/1986 Stucki ..... 297/300.3
4,640,547 A * 2/1987 Fromme ..... 297/300.3 X
4,640,548 A * 2/1987 Desanta ..... 297/300.3
4,668,012 A * 5/1987 Locher ..... 297/300.3
4,682,814 A * 7/1987 Hansen ..... 297/300.3
4,682,815 A * 7/1987 Steifensand ..... 297/300.3
4,684,173 A * 8/1987 Locher ..... 297/300.3
4,707,029 A * 11/1987 Korn ..... 297/300.3 X
4,709,962 A * 12/1987 Steinmann ..... 297/300.3
4,758,045 A * 7/1988 Edel et al. ..... 297/300.3
4,761,033 A * 8/1988 Lanuzzi et al. ..... 297/300.3
4,765,679 A 8/1988 Lanuzzi et al.
4,834,453 A * 5/1989 Makiol ..... 297/300.4
4,966,412 A * 10/1990 Dauphin ..... 297/300.3
4,986,601 A * 1/1991 Inoue ..... 297/300.4
4,988,145 A * 1/1991 Engel ..... 297/300.4
5,024,484 A * 6/1991 Buchacz ..... 297/300.3

(Continued)

FOREIGN PATENT DOCUMENTS

EP 69410 A1 * 6/1982 ..... 297/300.3
EP 69410 A1 * 1/1983 ..... 297/300.3
JP 2-257910 A 10/1990
JP 4-58905 A 2/1992
JP 6-227126 A 10/1994
JP 8-126548 A 5/1996
JP 10-179315 A 7/1998
JP 11-75990 A 3/1999

*Primary Examiner*—Rodney B. White
(74) *Attorney, Agent, or Firm*—Banner & Witcoff Ltd.

(57) ABSTRACT

In order to provide a chair that can support near a pelvis or a lumbar portion of a person who sits on the chair irrespective of a body proportion the person or a way to sit, a boundary portion K between a back and a seat is arranged to be transformable or movable and the boundary portion K can be fixed at a position where the boundary K pushes against near the pelvis of the person with an operation from outside

12 Claims, 11 Drawing Sheets

U.S. PATENT DOCUMENTS 5,052,753 A * 10/1991 Buchacz ..... 297/300.3
5,209,549 A * 5/1993 Chang ..... 297/320
5,335,969 A * 8/1994 Yamaguchi et al. . 297/300.3 X
5,348,371 A * 9/1994 Miotto ..... 297/300.4 X
5,597,203 A * 1/1997 Hubbard ..... 297/301.1 X
5,860,701 A * 1/1999 Jungjohann et al. . 297/300.4 X
5,909,924 A * 6/1999 Roslund, Jr. ..... 297/300.4
6,109,694 A * 8/2000 Kurtz ..... 297/320
6,149,236 A * 11/2000 Brauning ..... 297/301.2
6,382,719 B1 * 5/2002 Heidmann et al. ... 297/300.1 X
6,450,577 B1 * 9/2002 Roslund, Jr. ..... 297/300.4 X
6,588,843 B1 * 7/2003 Ebenstein ..... 297/300.1
6,609,755 B2 * 8/2003 Koepke et al. ..... 297/300.3 X
2002/0180252 A1 * 12/2002 Kinoshita et al. .... 297/300.4 X

* cited by examiner

CHAIR

This is a U.S. National Phase Application under 35 U.S.C. §371 and applicant herewith claims the benefit of priority of PCT/JP01/08732 filed Oct. 3, 2001, which was published Under PCT Article 21(2) in Japanese, which claims priority to Japanese Application Nos. P2000-314997, filed Oct. 16, 2000 and P2000-315781, filed Oct. 16, 2000, the entire contents of which are incorporated herein by reference.

FIELD OF THE ART

This invention-relates to a chair that can contribute to improvement in comfort to sit and that is mainly used preferably in a field of office automation such as an office.

BACKGROUND ART

Conventionally varieties of devices are contrived for chairs used in an office or the like in order to improve comfort to sit. As an example, a rear portion of a face to be seated is inclined a little so as to make the rear portion thereof lifted or a bottom portion of the back support is partially projected forward.

This arrangement makes it possible to coincide an angle of inclination of the rear portion of the face to be seated with an angle of a pelvis of a person who sits on the chair and to make the lower portion of the back support in a shape that supports a lumbar portion of the person who sits on the chair, which brings comfortable and stable feeling to sit.

However, if a shape of the rear portion of the face to be seated or of the bottom portion of the back support is standardized, the pelvis or lumbar portion of the person who sits on the chair might not be supported stably due to difference of a body proportion or of a way to sit, which might cause for the person uncomfortable feeling to sit.

In order to solve the above problems the present claimed invention intends to provide a chair in which a boundary between a seat and a back can be adjusted to a most comfortable position for a person who sits on the chair so as to obtain comfortable feeling to sit in spite of difference of a body proportion or of a way to sit.

DISCLOURE OF THE INVENTION

A chair in accordance with claim 1 of the present claimed invention is characterized by that a rear portion of a face to be seated can be transformed or moved and that an angle of inclination of the rear portion of the face to be seated to a front portion of the face to be seated can be changed steplessly or stepwisely by an operation from outside.

With the arrangement, it is possible to adjust a shape of the face to be seated so as to coincide an angle of a pelvis of a person who sits on the chair with an angle of inclination of the rear portion of the face to be seated, thereby to provide an extremely comfortable feeling to sit.

Supporting a lumbar portion of a person who sits on the chair from rearward with pushed against it contributes to improvement in a stable feeling or a fitting feeling for the person when he or she is seated. In order to meet this demand with a simple arrangement it is preferable that a lower portion of a back support is transformed or moved with the interlock to transformation or movement of the rear portion of the face to be seated.

As a preferable form of transformation or movement of a lower portion of the back support it is represented that a lower portion of a back support projects forward in accordance with forward inclination of the rear portion of the face to be seated. For example, if a person sits in a good posture, an angle of a pelvis of the person becomes near vertical and a lumbar portion of the person inclines forward. Then the above arrangement can cooperate with this posture.

As a concrete embodiment to make it possible to transform or move a rear portion of a face to be seated with a simple arrangement, it is preferable that a rear portion of a face to be seated is supported by an inclining body in which a rear end of the inclining body makes an up and down movement by a rotation of the inclining body with a front end thereof as a rotational axis and that an angle of inclination of the rear portion of the face to be seated to a front portion of the face to be seated can be varied steplessly or stepwisely by operating the inclining body from outside so as to incline.

As a concrete embodiment in order to make it possible to transform or move a lower portion of the back support, it is preferable that the rear end of the inclining body is provided with a lumbar support portion that supports a lower portion of a back support in a transformable or movable manner and the lumbar support portion projects forward in accordance with forward inclination of the inclining body and then the lower portion of the back support projects forward.

From a point of improving comfort feeling to sit on the chair in case that the lower portion of the back support projects forward, it is preferable to give tension to the lower portion of the back support. In order to meet this demand with a simple arrangement it is preferable that a covering member that constitutes the lower portion of the back support is supported at right and left thereof by the lumbar support portion and that tension of the covering member increases in accordance with forward projection of the lumbar support portion.

As a preferable embodiment for changing an angle of inclination of the inclining body or for fixing the inclining body it is represented by that one end of a stretching member whose length can be changed freely is rotatably connected with a supporting member such as a back support rod that supports the inclining body and the other end of the stretching member is rotatably connected with a position which is displaced from a rotational axis of the inclining body and the stretching member can be switched with an operation of an operating portion from a free condition in which the stretching member can be stretched or contracted freely to a locked condition in which a length of the stretching member is fixed. With this arrangement, since it is possible to integrally form a mechanism for driving the inclining body to incline with a mechanism for fixing the inclining body, a number of components can be reduced and usage can be convenient as well. The supporting member may be a component that supports the inclining body directly or indirectly, for example, and may be represented by a back support rod, a seat board, a leg body or the like.

As a more preferable embodiment in an arrangement that the seat board moves backward in accordance with backward inclination of the back support rod, it is represented that the inclining body is rotatably connected with the back support rod.

Light-weight or low-price is required for chairs used in an office or the like. Then a chair of a slide type is not preferable since a sliding mechanism becomes complicated, which will lead to increment of weight and a price as well. In addition, the slide-type chair has a defect that the sliding mechanism easily produces looseness.

A chair in accordance with claim 8 of the present claimed invention is, wherein a principle of the chair is shown in FIG. 9, characterized by that a lumbar support portion ALS having a body contact face A5*b* that can support a lumbar portion of a person who sits on the chair is provided and that the lumbar support portion ALS is rotatably supported so that the body contact face A5*b* makes a back and forth movement with a positive reverse turn movement of the lumbar support portion ALS.

The above-mentioned "a back and forth movement" means a movement that at least includes a movement of a back and forth direction.

In accordance with the arrangement, since the lumbar support portion ALS is supported rotatably, the mechanism is simpler in comparison with that of a slide-type chair, thereby to lighten weight of a chair as a whole and to reduce cost and to make a movement of the mechanism smooth as well. Further, since the lumbar support portion ALS is supported rotatably, the body contact face A5*b* makes a back and forth movement with a track thereof forming an arc. As a result, it is possible for the chair of the above arrangement to fit the lumbar support portion ALS into a sigmoid curve formed between a lumbar portion and a back of a person who sits on the chair more tightly in comparison with, for example, the slide-type chair wherein a body contact face moves back and forth in a straight line.

In order to increase degrees of freedom in arranging a position of a rotational axis AX of the lumbar support portion ALS so as to make it easy to improve comfort to sit on the chair, it is preferable that the lumbar support portion ALS is rotatably supported through a support arm A7.

More concretely, as shown in FIG. 10, it is represented that a rotational axis AX of the lumbar support portion ALS is arranged below a face to be seated A4*a*, A4*b*. This arrangement is especially preferable for a chair A1 whose face to be seated A4*a*, A4*b* makes a sliding movement along back and forth. The reason is that the face to be seated A4*a*, A4*b* does not interfere with a rotational axis of the lumbar support portion ALS due to a sliding movement of the face to be seated A4*a*, A4*b*.

If the lumbar support portion ALS is rotatably supported by the seat A4, as shown in FIG. 11, in case a chair that comprises a back A5 and a seat A4 and that the back AS is arranged so as to be able to incline to the seat A4, the lumbar support portion ALS does not move in spite of backward inclination of the back AS. As a result, it is possible for a person who sits on the chair to be in a refreshing posture with his or her spine straight.

The position of the rotational axis AX of the lumber support portion ALS may be variously modified. For example, as shown in FIG. 12, the rotational axis AX may be arranged on the back A5 and the lumber support portion ALS locates below the rotational axis AX.

If comfort to sit is pursued, it is preferable that a position of the boundary AK that corresponds to a portion between a lumbar portion and buttocks of a person who sits on the chair can be adjusted integrally. As a concrete embodiment of this arrangement it is represented that the inclining body A7 that supports the rear portion of the face to be seated A4*b* is integrally formed with the lumbar support portion ALS, the inclining body A7 inclines with a positive reverse turn movement of the lumbar support portion ALS so as to change an angle of inclination of the rear portion of the face to be seated A4*b* to the front portion of the face to be seated A4*a*. In this example shown in FIG. 13, the inclining body A7 serves as a supporting arm.

As another embodiment it is represented, as shown in FIG. 14, that a lower portion of a back support A5*b* as a body contact face that can support a lumbar portion of a person who sits on the chair is formed with a covering member A52 that covers the back support rod A51, right and left side edges of the covering member A52 are supported respectively by a pair of support frames A10 that can make a back and forth movement and that tension of the covering member A52 increases in accordance with a forward movement of the support frame A10. In accordance with the arrangement, the lumbar support portion ALS is formed with a pair of right and left support frames SA10 and the covering member A52, thereby to lighten weight and to simplify the arrangement. When the lower portion of the back support A5*b* as a body contact face projects forward, most cases are that a person sits in a good posture with strain. From the above point, it is very preferable that the lower portion of the back support A5*b* is difficult to transform due to increased tension of the covering member A52 in accordance with the forward movement of the lower portion of the back support A5*b*.

As a preferable driving mechanism for adjusting the position of the above lumbar support portion ALS it is represented that, although not shown in drawings, one end of an stretching member such as a gas spring whose length can be changed freely is rotatably fixed to a supporting member such as a seat board that supports the lumbar support portion ALS and that the other end of the stretching member is rotatably fixed to a position which is displaced from a rotational axis AX of the lumbar support portion ALS and that the stretching member can be switched with an operation of an operating portion from a free condition in which the stretching member is stretched or contracted freely to a locked condition in which a length of the stretching member is fixed. With this arrangement, it is possible to integrally form a mechanism for driving the inclining body to incline with a mechanism for fixing the inclining body, thereby to reduce a number of components.

BEST MODES OF EMBODYING THE INVENTION

Embodiments of the invention will be described with reference to drawings.

<First Embodiment>

A first embodiment of the invention will be described in detail with reference to an embodiment thereof shown in FIG. 1 through FIG. 4.

Figure 1:
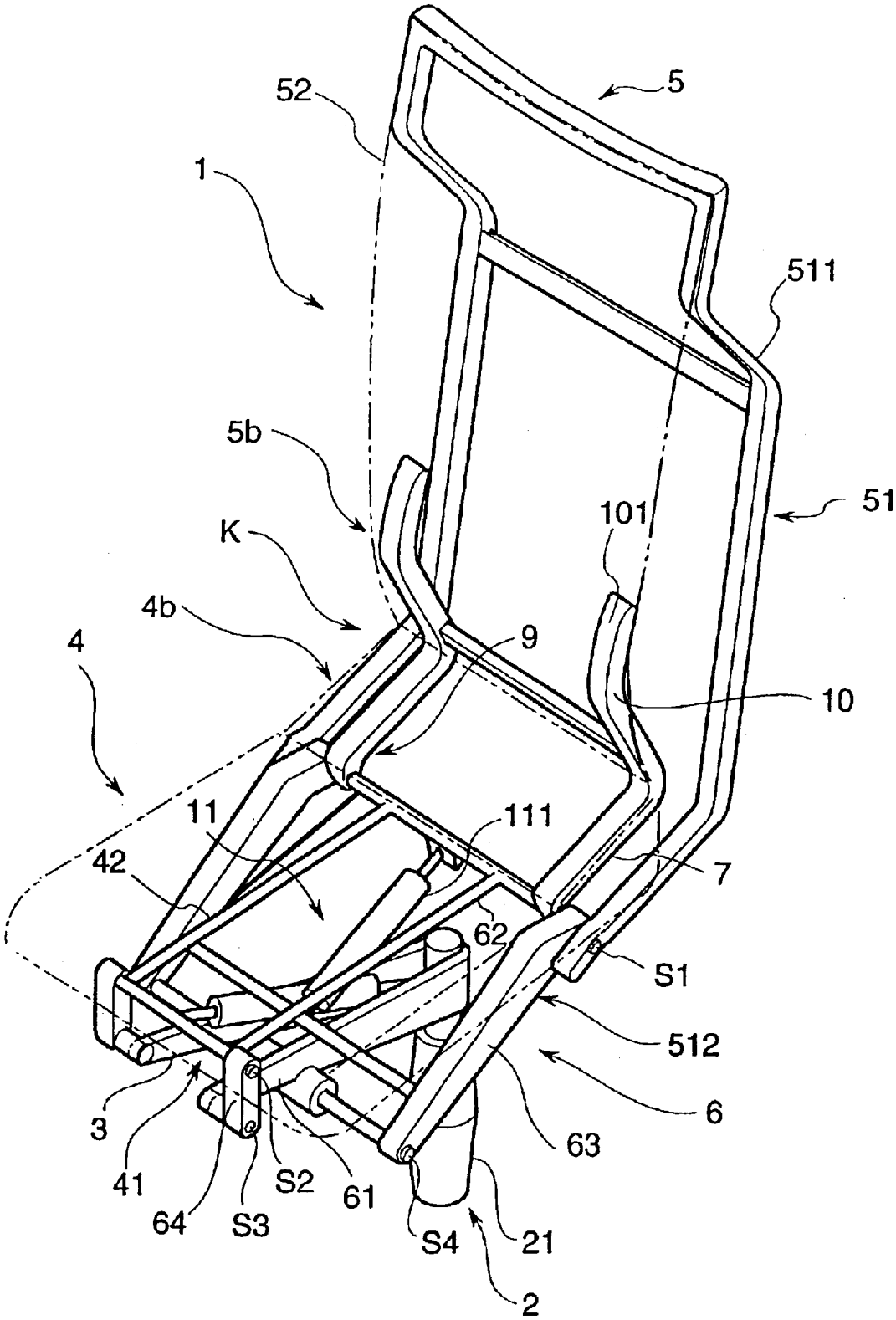
FIG. 1 is a partial perspective view showing a fundamental arrangement of inside a chair in accordance with a first embodiment of the present claimed invention.

FIG. 1 shows a perspective view showing a principal part of a chair 1 showing an embodiment of the present claimed invention. The chair 1 comprises a base leg 2, a support base 3 mounted on the base leg 2, a seat 4 and a back 5 supported by the support base 3 through a four-side link mechanism 6 and is so arranged that the seat 4 moves rearward in accordance with a rearward rocking movement of the back 5 by an action of the four-side link mechanism 6.

The support base 3 is lengthy and so arranged that a bottom end of the support base 3 is fittingly fixed over a top end of a support post 21 that constitutes the base leg 2 and that a top end of the support base 3 extends at an angle to a forward direction.

The seat 4 is so arranged that a cushion or the like is mounted on a seat board 41, wherein the seat board 41 comprises a seat frame 42.

The back 5 is so arranged that a covering member 52 is mounted on a back support rod 51 of a frame shape and has an appearance of upstanding continuously from a rear end of the seat 4. The back support rod 51 mainly comprises an upper frame 511 that is a part corresponding to a back support and a lower frame 512 that locates below the seat board 41. The upper frame 511 and the lower frame 512 are rotatably connected each other through a supporting axis S1 that extends right and left horizontally and a stopping mechanism, not shown in drawings, that can prohibit rotation of the upper frame 511 and the lower frame 512 is provided. The stopping mechanism is to fix the upper frame 511 and the lower frame 512 so as to prevent rotation, for example, by inserting a pin therein. The stopping mechanism is so arranged that the pin can be inserted or removed and then a user of the chair can switch the stopping mechanism from an able-to-rotate state wherein both of the upper frame 511 and the lower frame 512 are able to rotate and the upper frame 511 alone can be inclined to an unable-to-rotate state wherein the upper frame 511 and the lower frame 512 are fixedly connected each other and whole of the back support rod 511 can make a rocking movement.

Figure 2:
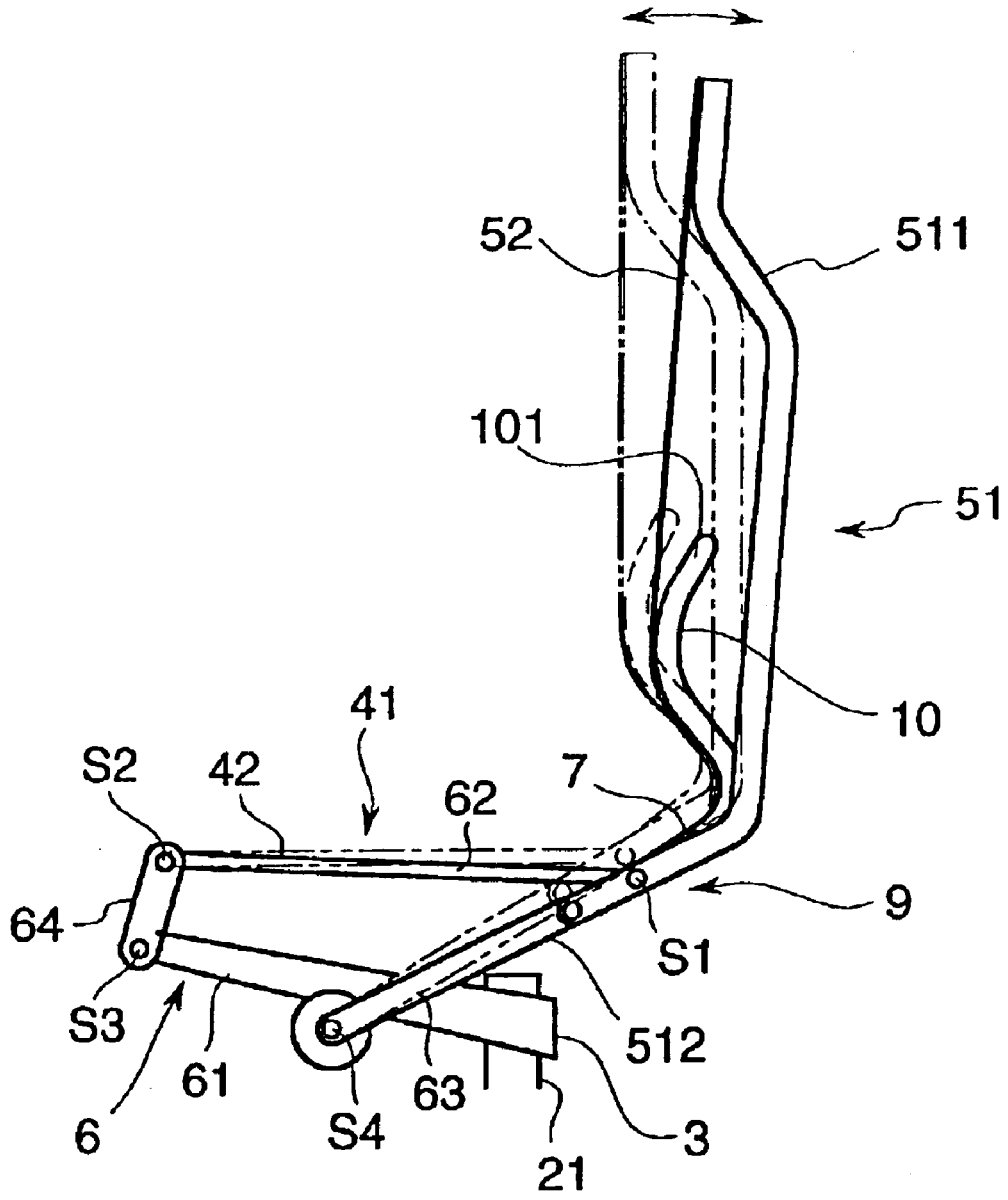
FIG. 2 is a general side cross-sectional view showing the chair of the embodiment, especially, an arrangement of a four-side link mechanism.

The four-side link mechanism 6 is, as shown in FIG. 2, so arranged that edges of four link members 61, 62, 63, 64 are rotatably connected through a supporting axis S1, S2, S3, S4 so that connected points form a trapezium in a side view. More concretely, the support base 3 serves as a lower link member 61, the seat frame 42 serves as an upper link member 62, the lower frame 512 serves as a rear link member 63 and a front link member 64 is arranged to connect front ends of the support base 3 and the seat frame 42.

Figure 3:
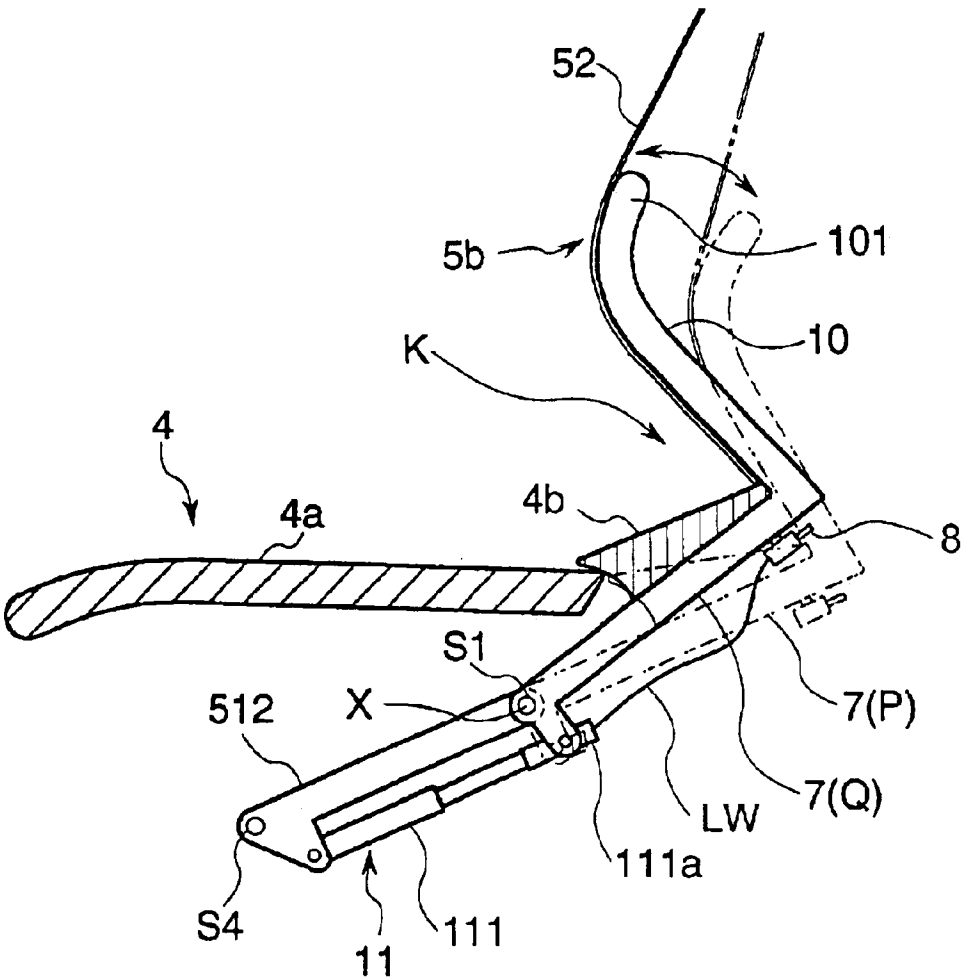
FIG. 3 is a partial side cross-sectional view mainly showing an inclining body and a lumbar support portion of the embodiment.

In this embodiment, as shown in FIG. 3, an inclining body 7 is arranged at a back of the seat frame 42, a rear end of a cushion or the like that constitutes a face to be seated 4*a*, 4*b* is supported by the inclining body 7 from below, a lumbar support portion 10 is integrally formed with a rear end of the inclining body 7 and the covering member 52 that forms a lower portion of a back support 5*b* is supported by the lumbar support portion 10. The inclining body 7 and the lumbar support portion 10 integrated therewith are moved through a driving mechanism 11 with an operation of an operating lever 8 as an operating portion so as to transform a boundary portion E between the seat and the back comprising a rear portion of the face to be seated 4*b* and the lower portion of the back support 5*b*.

More specifically, the inclining body 7 is a pair of right and left frames extending back and forth and is supported by the back support rod 51 through a supporting mechanism 9 in a condition where a position of the inclining body 7 can be changed. The supporting mechanism 9 connects the inclining body 7 with the lower frame 512 rotatably through the supporting axis S1 at an inclining fulcrum X provided at the front end of the inclining body 7. And the rear portion of the face to be seated 4*b* is supported by the inclining body 7 so as to incline between a lower position P (shown by an imaginary line in FIG. 3) that is generally at the same level as a front portion of the face to be seated 4*a* and an upper position O where the rear end of the inclining body 7 is lifted from the lower position P.

The driving mechanism 11 that drives the inclining body 7 is so made that one end of a gas spring 111 as an stretching member whose length can be changed freely is rotatably fixed to the back support rod 51 as a supporting member (more specifically, to the lower frame 512) and that the other end of the gas spring 111 is rotatably fixed to a position which is displaced from the inclining fulcrum X of the inclining body 7. The operating lever 8 arranged under the seat 5 and an operating portion 111*a* of the gas spring 111 are connected with a link wire LW and the gas spring 111 can be switched with an operation of the operating lever 8 from a free condition in which the gas spring 111 is stretched or contracted freely to a locked condition in which a length of the gas spring 111 is fixed. In the free condition force is always applied to the inclining body 7 to incline forward due to stretching force of the gas spring 111.

The lumbar support portion 10 is in a frame shape which extends integrally from the rear end of the inclining body 7 to be bent generally at a right angle in a side view and supports right and left side edges of the covering member 52 that forms the lower portion of the back support 5*b*. The lumbar support portion 10 projects forward when the inclining body 7 moves from the lower position P to the upper position O and then makes the lower portion of the back support 5*b* project forward by increasing tension of the covering member 52. At a top end of the lumbar support portion 10 provided is a bent portion 101 that is bent backward with forming an arc, which improves a feeling to touch a hipbone of a person who sits on the chair 1. In the unable-to-rotate state where the upper frame 511 and the lower frame 512 are fixedly connected each other the inclining body 7 is arranged to locate at a position where the back support is usually formed when the inclining body 7 is set at the lower position 2 and to project forward by the same amount as the inclining body 7 moves from the lower position P to a direction of the upper position O.

With the chair 1 in accordance with an arrangement of the embodiment, in order to adjust a position of the inclining body 7 and the lumbar support portion 10, first operate the operating lever 8 to make the gas spring 111 in a free condition. Then operate the inclining body 7 and the lumbar support portion 10 toward a direction of inclining backward until the inclining body 7 and the lumbar support portion 10 incline by a desired angle against stretching force of the gas spring 111, operate the operating lever 8 in an opposite manner to make the gas spring 111 in a locked condition and then fix the inclining body 7 and the lumbar support portion 10 so as not to change the angle of inclination. More concretely, the person who sits on the chair 1 adjusts a position of the inclining body 7 and the lumbar support portion 10 while he or she leans against the back 5.

In accordance with the embodiment, since it is possible to transform the boundary portion E between the seat and the back so as to be suited along a pelvis angle or a lumbar portion of the person who sits on the chair 1 irrespective of difference in a body proportion of the person or in a way to sit, thereby to provide the extremely comfortable chair 1.

Further, with the embodiment, since tension of the covering member 52 constituting the lower portion of the back support 5*b* increases according to forward projection of the lumbar support portion 10, tension is given to the lower portion of the back support 5*b* when the lower portion of the back support 5*b* projects forward, resulting in contribution to improvement in a feeling to sit.

This invention is not limited to the above-described embodiment.

Figure 4:
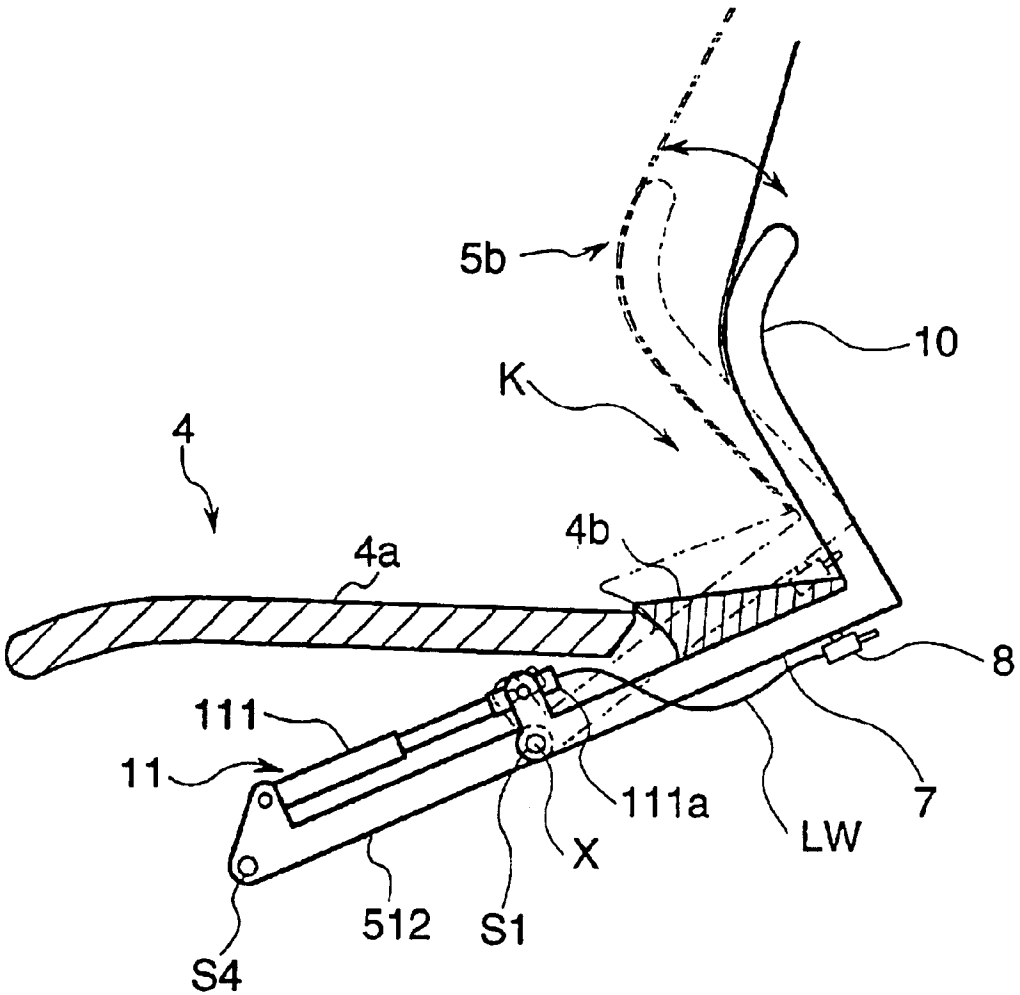
FIG. 4 is a partial side cross-sectional view mainly showing an inclining body and a lumbar support portion of a modification of the embodiment.

For example, as shown in FIG. 4, force may be applied to the inclining body 7 to incline backward due to stretching force of the gas spring 111 when the gas spring 111 is in a free condition. In this case, in order to adjust a position of the inclining body 7 and the lumbar support portion 10, first operate the operating lever 8 to make the gas spring 111 in a free condition. Then operate the inclining body 7 and the lumbar support portion 10 toward a direction of inclining forward until the inclining body 7 and the lumbar support portion 10 incline by a desired angle against stretching force of the gas spring 111, operate the operating lever 8 in an opposite manner to make the gas spring 111 in a locked condition and then fix the inclining body 7 and the lumbar support portion 10 so as not to change the angle of inclination. In this figure, the same numeral is given to a component corresponding to the above embodiment.

In addition to the above arrangement in which the inclining body 7 can be fixed steplessly between the upper position O and the lower position P, the inclining body may be fixed to one of several stepwisely predetermined positions by the use of a ratchet mechanism.

Further, the inclining body may be supported by the seat board.

The same effect can be produced if the present claimed invention is applied to not only the above-mentioned rocking chair but also a chair which is a type where a back is fixed to a seat and does not make a rocking movement or a chair without a back where a rear portion of a face to be seated is inclined.

<Second Embodiment>

A second embodiment of the invention will be described in detail with reference to an embodiment thereof shown in FIG. 5 through FIG. 8. The numerals given to each component in the first embodiment are not related to numerals given to components in the second embodiment. Same numerals are given to components corresponding to the components shown in FIG. 9 through FIG. 14.

Figure 5:
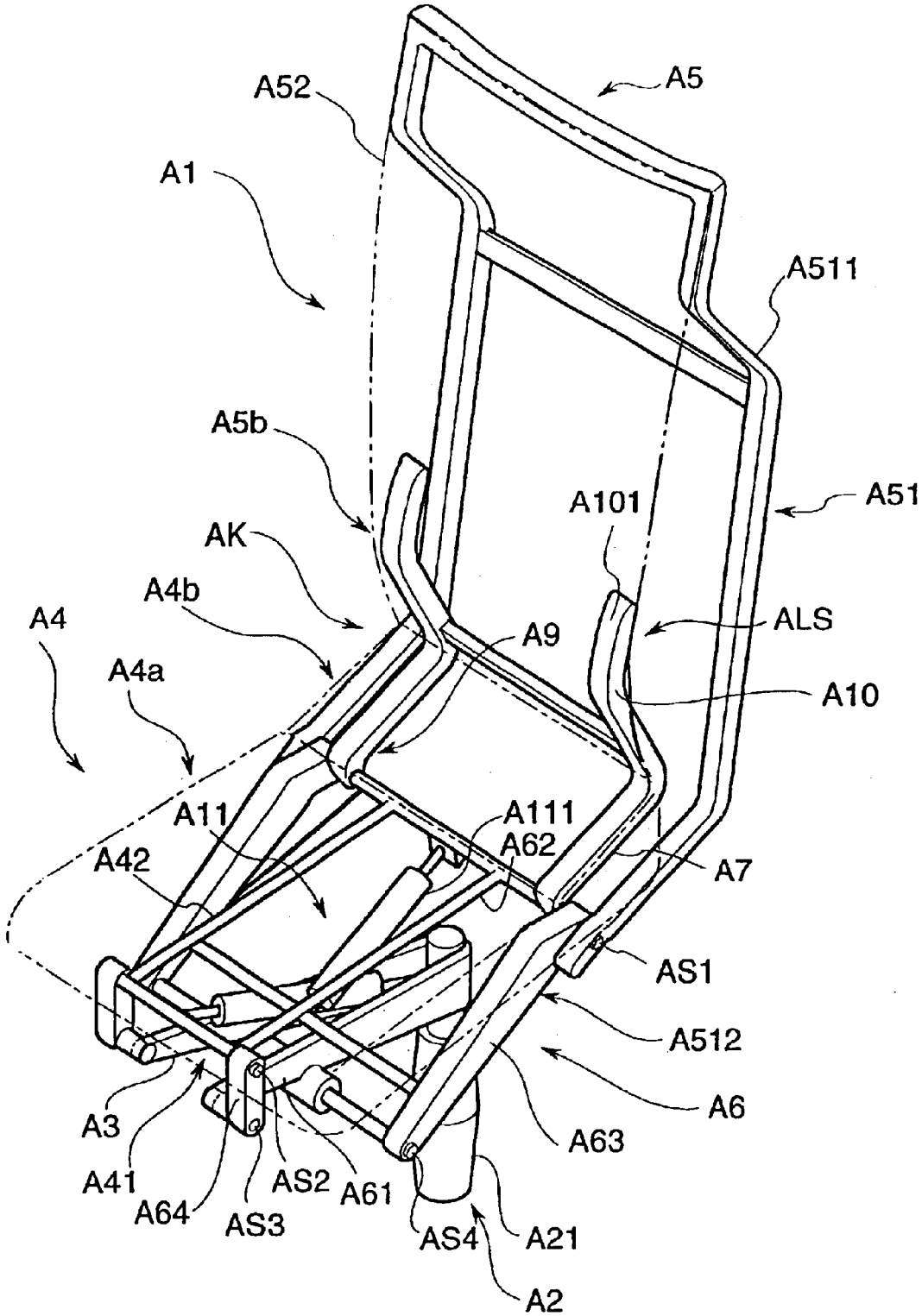
FIG. 5 is a partial perspective view showing a fundamental arrangement of inside a chair in accordance with a second embodiment of the present claimed invention

FIG. 5 shows a perspective view showing a principal part of a chair A1 showing an embodiment of the present claimed invention. The chair A1 comprises a base leg A2, a support base A3 mounted on the base leg A2, a seat A4 and a back A5 supported by the support base A3 through a four-side link mechanism A6 and is so arranged that the seat A4 moves rearward in accordance with a rearward rocking movement of the back A5 by an action of the four-side link mechanism A6.

The support base A3 is lengthy and so arranged that a bottom end of the support base A3 is fittingly fixed over a top end of a support post A21 that constitutes the base leg A2 and that a top end of the support base A3 extends at an angle to a forward direction.

The seat A4 is so arranged that a face to be seated can make a back and forth movement slidably to a seat board A41. More concretely, a cushion or the like is mounted on the seat board A41 through a sliding mechanism, not shown in drawings, in a condition of making a back and forth movement slidably.

The back A5 is so arranged that a covering member A52 is mounted on a back support rod A51 and produces a property of a cushion without a cushion by making use of tension of the covering member A52. The back support rod A51 mainly comprises an upper frame A511 that is a part corresponding to a back support and a lower frame A512 that locates below the seat board A41. The upper frame A511 and the lower frame A512 are rotatably connected each other through a supporting axis AS1 that extends right and left horizontally and a stopping mechanism, not shown in drawings, that can prohibit rotation of the upper frame A511 and the lower frame A512 is provided. The stopping mechanism is to fix the upper frame A511 and the lower frame A512 so as to prevent rotation, for example, by inserting a pin therein. The stopping mechanism is so arranged that the pin can be inserted or removed and then a user of the chair can switch the stopping mechanism from an able-to-rotate state wherein both of the upper frame A511 and the lower frame A512 are able to rotate and the upper frame A511 alone can be inclined to an unable-to-rotate state wherein the upper frame A511 and the lower frame A512 are fixedly connected each other and whole of the back support rod A511 can make a rocking movement.

Figure 6:
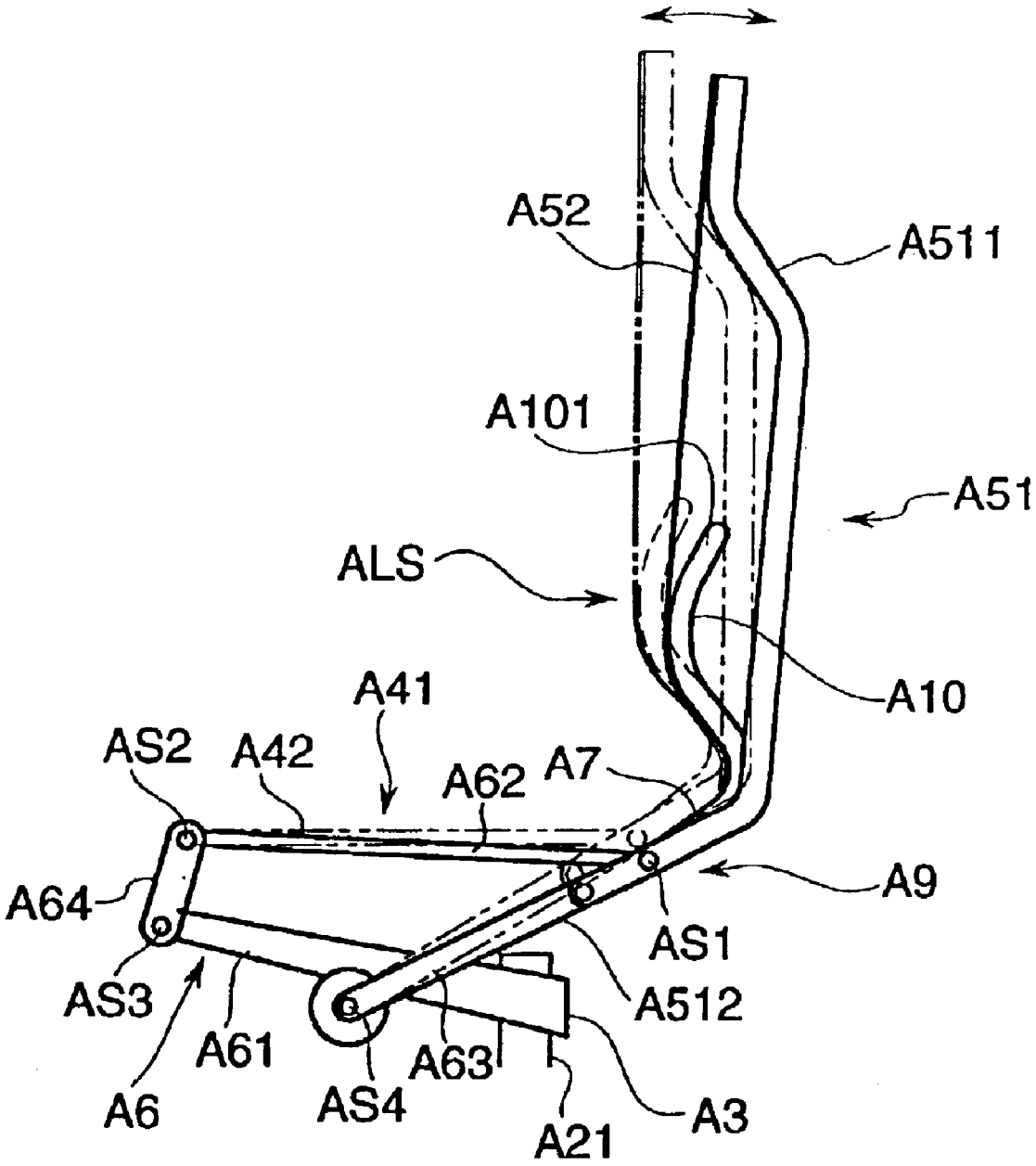
FIG. 6 is a general side cross-sectional view showing the chair of the embodiment, especially, an arrangement of a four-side link mechanism.

The four-side link mechanism A6 is, as shown in FIG. 6, so arranged that edges of four link members A61, A62, A63, A64 are rotatably connected-through a supporting axis AS1, AS2, AS3, AS4 so that connected points form a trapezium in a side view. More concretely, the support base A3 serves as a lower link member A61, the seat frame A42 serves as an upper link member A62, the lower frame A512 serves as a rear link member A63 and a front link member A64 is arranged to connect front ends of the support base A3 and the seat frame A42.

Figure 7:
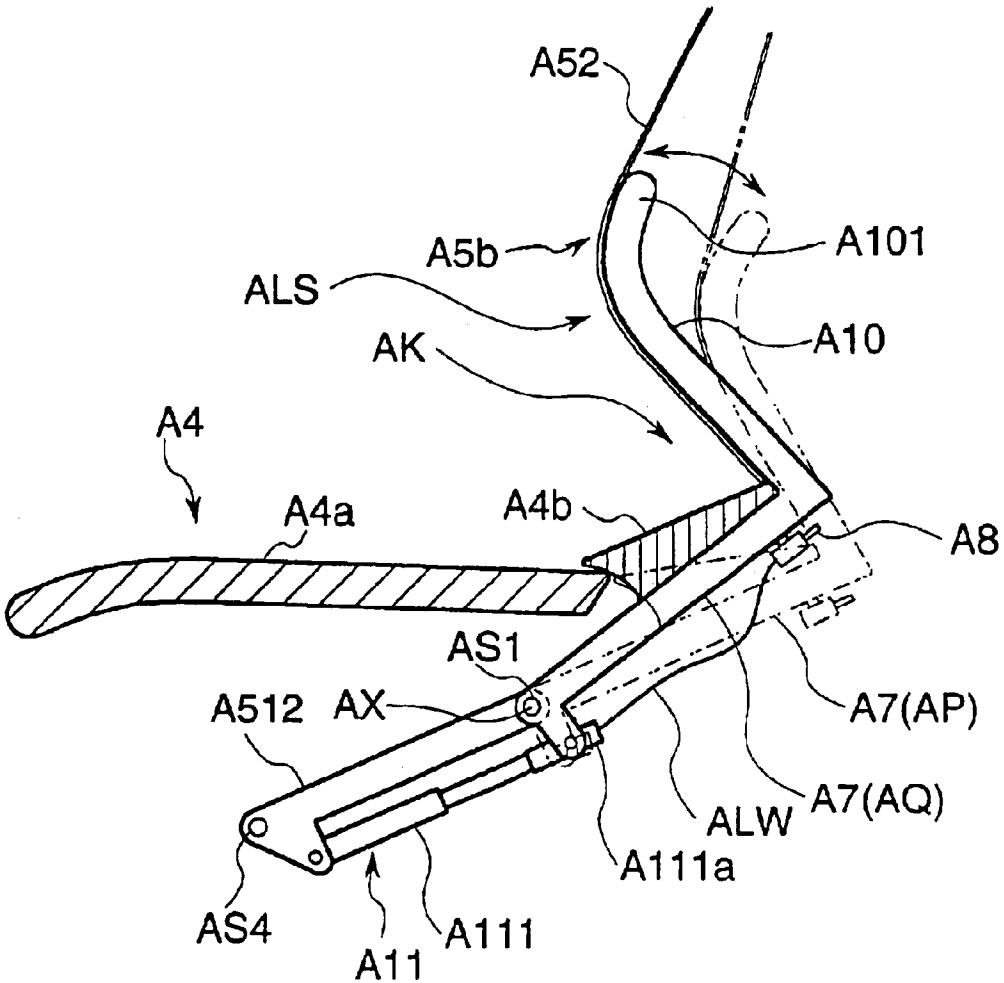
FIG. 7 is a partial side cross-sectional view mainly showing an inclining body and a lumbar support portion of the embodiment.

In this embodiment, as shown in FIG. 7, an inclining body A7 is arranged at a back of the seat frame A42, a rear end of a cushion or the like that constitutes a face to be seated A4*a*, A4*b* is supported by the inclining body A7 from below, a support frame A10 that constitutes a lumbar support portion is integrally formed with a rear end of the inclining body A7 and the covering member A52 that forms a lower portion of a back support A5*b* is supported by the support frame A10. The inclining body A7 and the support frame A10 integrated therewith are moved through a driving mechanism All with an operation of an operating lever A8 as an operating portion so as to transform a boundary portion AK between the seat and the back comprising a rear portion of the face to be seated A4*b* and the lower portion of the back support A5*b*.

More specifically, the inclining body A7 is a pair of right and left frames extending back and forth and serves as a supporting arm. The inclining body A7 is supported by the back support rod A51 through a supporting mechanism A9 in a condition where a position of the inclining body A7 can be changed. The supporting mechanism A9 connects the inclining body A7 with the lower frame A512 rotatably through the supporting axis AS1 at an inclining fulcrum AX provided at the front end of the inclining body A7. And the rear portion of the face to be seated A4*b* is supported by the inclining body A7 so as to incline between a lower position AE (shown by an imaginary line in FIG. 7) that is generally at the same level as a front portion of the face to be seated A4*a* and an upper position AO where the rear end of the inclining body A7 is lifted from the lower position AP.

The driving mechanism All that drives the inclining body A7 is so made that one end of a gas spring A111 as an stretching member whose length can be changed freely is rotatably fixed to the back support rod A51 as a supporting member (more specifically, to the lower frame A512) and that the other end of the gas spring A111 is rotatably fixed to a position which is displaced from the inclining fulcrum AX of the inclining body A7. The operating lever A8 arranged under the seat A5 and an operating portion A111*a* of the gas spring A111 are connected with a link wire ALW and the gas spring A111 can be switched with an operation of the operating lever A8 from a free condition in which the gas spring A111 is stretched or contracted freely to a locked condition in which a length of the gas spring A111 is fixed. In the free condition force is always applied to the inclining body A7 to incline forward due to stretching force of the gas spring A111.

The support frame A10 is in a frame shape which extends integrally from the rear end of the inclining body A7 to be bent generally at a right angle in a side view and supports right and left side edges of the covering member A52 that forms the lower portion of the back support A5*b*. The support frame A10 projects forward when the inclining body A7 moves from the lower position AP to the upper position AO and then makes the lower portion of the back support A5*b* project forward by increasing tension of the covering member A52. The lumber support portion comprises a pair of support frames A10 and the covering member A52 covering with tension therebetween. At a top end of the support frame A10 provided is a bent portion A101 that is bent backward with forming an arc, which improves a feeling to touch a hipbone of a person who sits on the chair A1. In the unable-to-rotate state where the upper frame A511 and the lower frame A512 are fixedly connected each other the inclining body A7 is arranged to locate at a position where the back support is usually formed when the inclining body A7 is set at the lower position AP and to project forward by the same amount as the inclining body A7 moves from the lower position AP to a direction of the upper position O.

With the chair A1 in accordance with an arrangement of the embodiment, in order to adjust a position of the inclining body A7 and the support frame A10, first operate the operating lever A8 to make the gas spring A111 in a free condition. Then operate the inclining body A7 and the support frame A10 toward a direction of inclining backward until the inclining body A7 and the support frame A10 incline by a desired angle against stretching force of the gas spring A111, operate the operating lever A8 in an opposite manner to make the gas spring A111 in a locked condition and then fix the inclining body A7 and the support frame A10 so as not to change the angle of inclination. More concretely, the person who sits on the chair A1 adjusts a position of the inclining body A7 and the support frame A10 while he or she leans against the back A5.

In accordance with the embodiment, since it is possible to transform the boundary portion AK between the seat and the back so as to be suited along a pelvis angle or a lumbar portion of the person who sits on the chair A1 irrespective of difference in a body proportion of the person or in a way to sit, thereby to provide the extremely comfortable chair A1.

Further, with the embodiment, since tension of the covering member A52 constituting the lower portion of the back support A5*b* increases according to forward projection of the support frame A10, tension is given to the lower portion of the back support A5*b* when the lower portion of the back support A5*b* projects forward, resulting in contribution to improvement in a feeling to sit.

This invention is not limited to the above-described embodiment.

Figure 8:
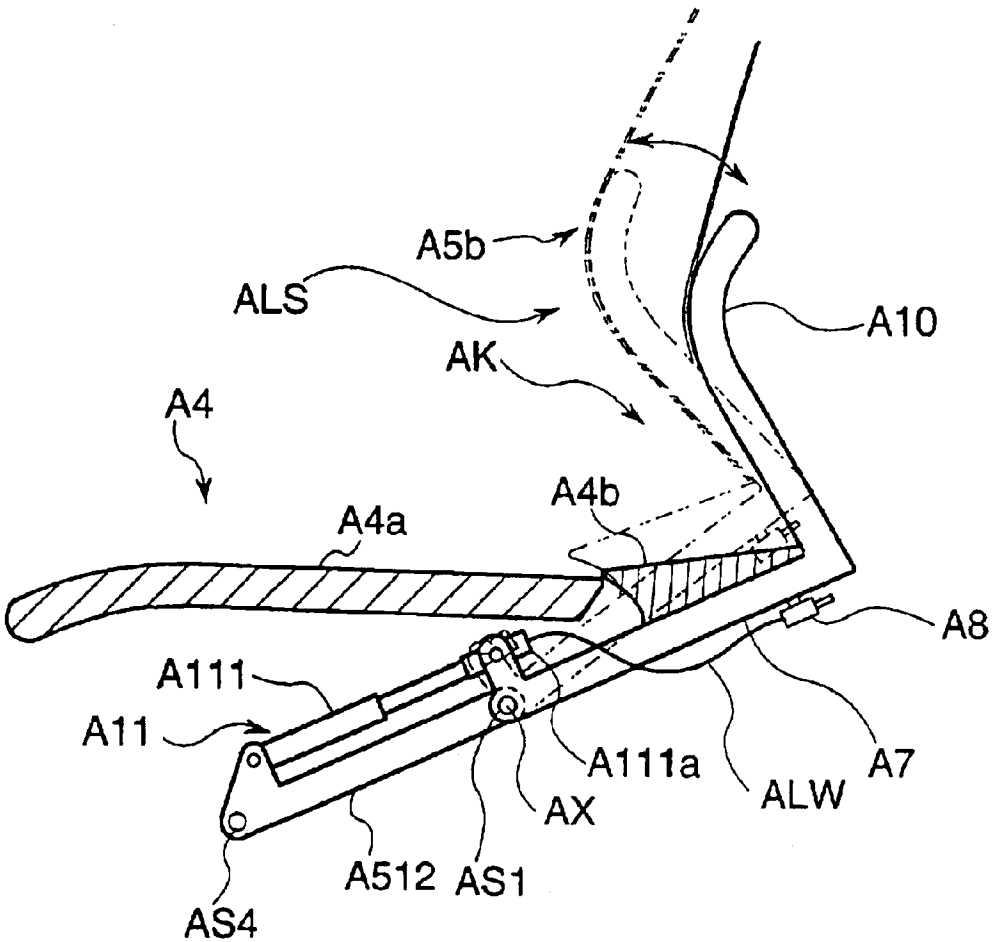
FIG. 8 is a partial side cross-sectional view mainly showing an inclining body and a lumbar support portion of a modification of the embodiment.
Figure 9:
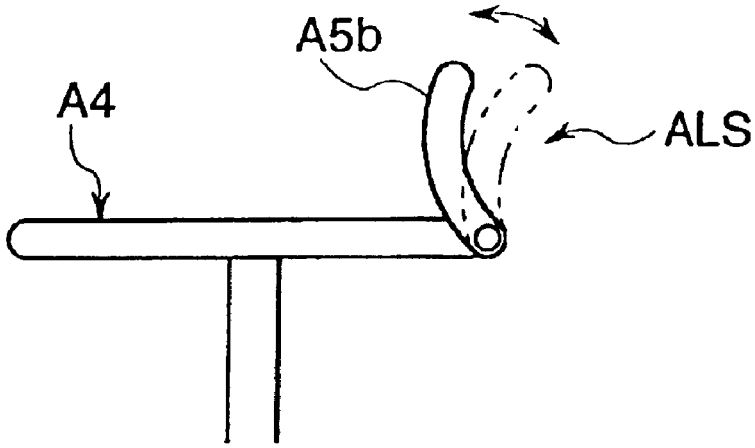
FIG. 9 is a side view showing a principle of the chair in accordance with the present claimed invention.
Figure 10:
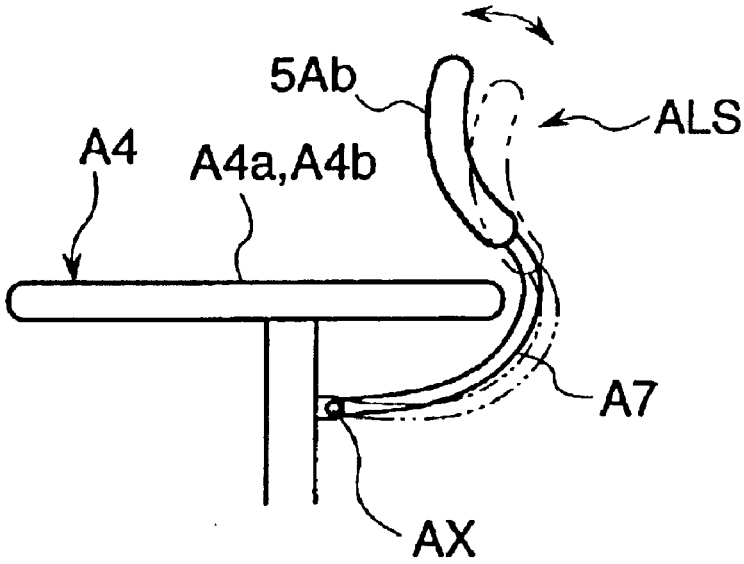
FIG. 10 is a side view showing a principle of the chair in accordance with the present claimed invention
Figure 11:
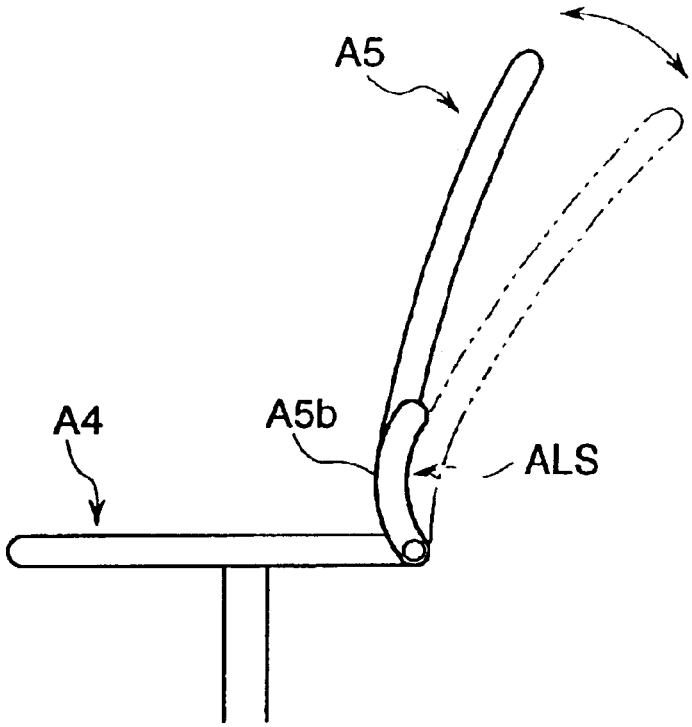
FIG. 11 is a side view showing a principle of the chair in accordance with the present claimed invention
Figure 12:
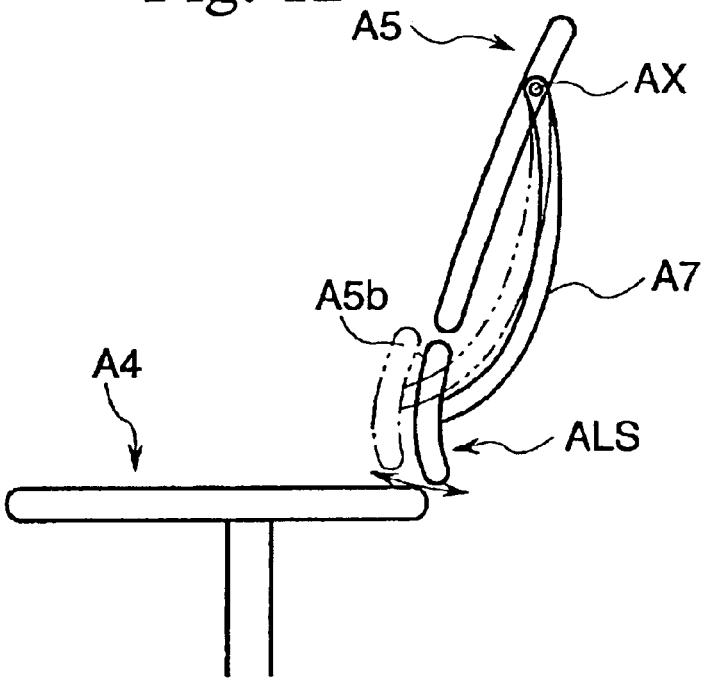
FIG. 12 is a side view showing a principle of the chair in accordance with the present claimed invention
Figure 13:
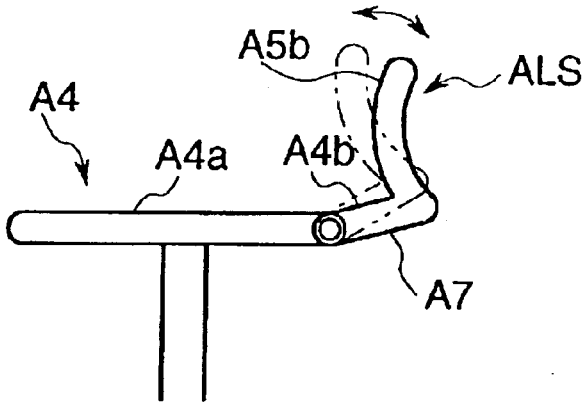
FIG. 13 is a side view showing a principle of the chair in accordance with the present claimed invention
Figure 14:
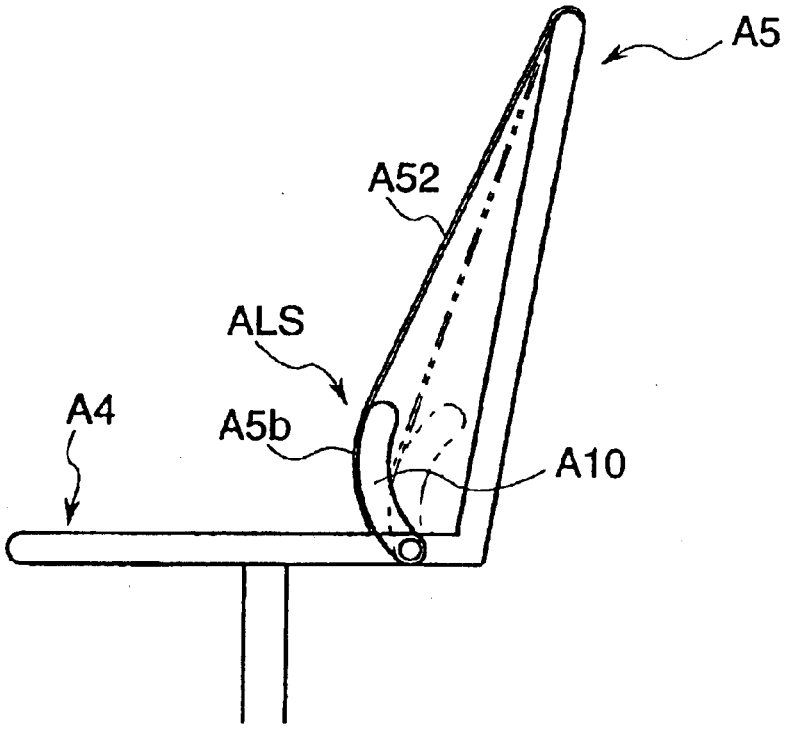
FIG. 14 is a partial perspective view showing a principle of the chair in accordance with the present claimed invention

For example, as shown in FIG. 8, force may be applied to the inclining body A7 to incline backward due to stretching force of the gas spring A111 when the gas spring A111 is in a free condition. In this case, in order to adjust a position of the inclining body A7 and the support frame A10, first operate the operating lever A8 to make the gas spring A111 in a free condition. Then operate the inclining body A7 and the support frame A10 toward a direction of inclining forward until the inclining body A7 and the support frame A10 incline by a desired angle against stretching force of the gas spring A111, operate the operating lever A8 in an opposite manner to make the gas spring A111 in a locked condition and then fix the inclining body A7 and the support frame A10 so as not to change the angle of inclination.

In addition to the above arrangement in which the inclining body A7 can be fixed steplessly between the upper position AO and the lower position AP, the inclining body may be fixed to one of several stepwisely predetermined positions by the use of a ratchet mechanism.

Further, the inclining body may be supported by the seat board.

The same effect can be produced if the present claimed invention is applied to not only the above-mentioned rocking chair but also a chair which is a type where a back is fixed to a seat and does not make a rocking movement or a chair without a back where a rear portion of a face to be seated is inclined.

POSSIBLE APPLICATIONS IN INDUSTRY

As mentioned above, in accordance with the present claimed invention, it is possible to make the chair extremely comfortable to sit since a shape of a face to be seated can be adjusted to coincide an angle of a pelvis of a person who sits on the chair with an angle of inclination of a rear portion of the face to be seated.

With an arrangement in which the lumbar support portion is rotatably supported, the arrangement becomes simple, thereby to lighten weight and to reduce cost of the chair as a whole. In addition, the lumbar support portion of the above arrangement moves smoother in comparison with that of a slide-type chair. Further, since the lumbar support portion is supported rotatably, the body contact face moves along an arc with making a back and forth movement. As a result, it is possible for the chair of the above arrangement to fit the lumbar support portion into a sigmoid curve formed between a lumbar portion and a back of a person who sits on the chair more tightly when compared with, for example, the slide-type chair wherein a body contact face moves back and forth in a straight line.

What is claimed is:

1. A chair comprising:

a seat face having a front portion and a rear portion;

a seat frame supporting the front portion of the seat face;

a back support having an upper portion and a lower portion;

an upper frame supporting the upper portion of the back support, the upper frame being rotatably supported by a supporting member;

an inclining body supporting the rear portion of the seat face, wherein the inclining body is supported by the supporting member so as to be rotatable independently of the seat frame and the upper frame, the inclining body having a lumbar support portion that supports the lower portion of the back support; wherein an upward movement of the rear portion of the seat face to the front portion of the seat face, caused by inclining the inclining body without moving the seat frame and the upper frame, occurs with a forward projection of the lower portion of the back support to transform the back support.

2. The chair described in claim 1, wherein a rear end of the inclining body makes an up and down movement by a rotation of the inclining body with a front end thereof as a rotational axis, wherein an angle of inclination of the rear portion of the seat face to the front portion of the seat face is variable and changes, with or without interval positions, by inclining the inclining body.

3. The chair described in claim 2, wherein each rotational axis of the lumbar support portion and the inclining body is arranged below the seat face.

4. The chair described in claim 1, wherein the lumbar support portion is provided at the rear end portion of the inclining body and transforms to support the lower portion of the back support, wherein the lumbar support portion projects forward in accordance with a forward inclination of the inclining body to cause the lower portion of the back support to project forward.

5. The chair described in claim 4, wherein each rotational axis of the lumbar support portion and the inclining body is arranged below the seat face.

6. The chair described in claim 1, wherein the lower portion of the back support comprises a covering member supported at right and left thereof by the lumbar support portion and tension of the covering member increases in accordance with forward projection of the lumbar support portion.

7. The chair described in claim 6, wherein each rotational axis of the lumbar support portion and the inclining body is arranged below the seat face.

8. A chair according to claim 6, wherein the lumbar support portion comprises a pair of support frames, the covering member is supported at right and left side edges by the pair of support frames respectively, and tension of the covering member increases in accordance with a forward movement of the pair of support frames.

9. The chair described in claim 8, wherein each rotational axis of the lumbar support portion and the inclining body is arranged below the seat face.

10. The chair described in claim 1, wherein one end of a stretching member whose length changes freely is rotatably connected with the supporting member and the other end of the stretching member is rotatably connected with a position which is displaced from a rotational axis of the inclining body and the stretching member is switchable with an operation of an operating portion from a free condition in which the stretching member is stretched or contracted freely to a locked condition in which a length of the stretching member is fixed.

11. The chair described in claim 10, wherein each rotational axis of the lumbar support portion and the inclining body is arranged below the seat face.

12. The chair described in claim 1, wherein each rotational axis of the lumbar support portion and the inclining body is arranged below the seat face.

* * * * *